US005954221A

United States Patent [19]

Boland

[11] Patent Number: 5,954,221

[45] Date of Patent: Sep. 21, 1999

[54] METHOD FOR COLLECTING DEBRIS ENTERING INTO A DUCT

[76] Inventor: Michael P. Boland, 9812 S. Ridgeway Ave., Evergreen Park, Ill. 60805

[21] Appl. No.: 09/099,687

[22] Filed: Jun. 18, 1998

Related U.S. Application Data

[63] Continuation of application No. 09/085,239, May 27, 1998, which is a continuation-in-part of application No. 08/797, 410, Feb. 10, 1997, Pat. No. 5,797,512.

[51] Int. Cl.[6] ..... B65D 33/00

[52] U.S. Cl. ..... 220/495.08; 220/495.06

[58] Field of Search ..... 220/495.06, 495.08, 220/9.1

[56] References Cited

U.S. PATENT DOCUMENTS

| | | | |
|---|---|---|---|
| 2,610,757 | 9/1952 | Irvine | 220/403 |
| 2,821,262 | 1/1958 | Godwin | 183/52 |
| 3,422,985 | 1/1969 | Rinehart | 220/404 X |
| 3,487,989 | 1/1970 | Rausing et al. | 220/404 X |
| 3,596,441 | 8/1971 | Lundahl | 55/376 |
| 3,606,740 | 9/1971 | Ballennie | 55/500 |
| 3,966,434 | 6/1976 | Frazier | 55/96 |
| 3,977,450 | 8/1976 | Schampier | 220/404 X |
| 4,919,546 | 4/1990 | Imazeki et al. | 220/403 X |
| 4,948,266 | 8/1990 | Bencic | 220/404 X |
| 5,636,871 | 6/1997 | Field | 220/404 X |
| 5,797,512 | 8/1998 | Bolan | 220/495.06 X |

*Primary Examiner*—Steven Pollard

*Attorney, Agent, or Firm*—Trexler, Bushnell, Giangiorgi & Blackstone, Ltd.

[57] ABSTRACT

A collection device and method for collecting debris entering into an opening of a duct associated with a ventilation system of a house or other building. The device including a basket having a fastening portion and a collecting portion detachably secured to the fastening portion. The fastening portion is adapted to be secured to a duct or to a sub-flooring adjacent the opening, and the collecting portion is adapted to extend into the duct and receive the debris. The collecting portion defines a vent, and the collection device includes a damper associated with the collecting portion for opening the vent when air is passing therethrough. A strap in the form of a drawstring may be included for detaching the collecting portion from the fastening portion and removing the collecting portion from the sub-flooring or the duct. The collection device may include a weight for maintaining the basket within the duct.

22 Claims, 3 Drawing Sheets

METHOD FOR COLLECTING DEBRIS ENTERING INTO A DUCT

This is a continuation of U.S. patent application Ser. No. 09/085,239, filed May 27, 1998, which is a continuation-in-part of U.S. patent application Ser. No. 08/797,410, filed Feb. 10, 1997, now U.S. Pat. No. 5,797,512.

FIELD OF THE INVENTION

The present invention relates to a device and method for collecting debris entering into a duct of a ventilation system of a house or other building during construction of the building or during remodeling or the like.

BACKGROUND

The construction of a house involves several stages. One of the preliminary stages of construction is the "rough stage," during which rough carpentry occurs and the frame of the house is constructed and the duct work for the forced air system or other ventilation system is laid.

Typically, once the rough stage is completed or as part of the rough stage, the "prep stage" occurs, during which the various trades, such as plumbers, heating contractors and electricians, conduct their initial preparation work. As each of the various trades works during the prep stage, debris, such as, for example, wood particles, metal particles, wiring and conduit particles, dust, etc., tends to build up inside the house. The debris tends to settle on the sub-flooring but also tends to fall into the duct openings associated with the sub-flooring. While the debris that settles on the sub-flooring can be cleaned relatively easily, the debris that falls into such floor duct openings can not be readily removed. Such debris and other matter can also have significant detrimental effects on the ventilation system and result in a poor breathing environment for the occupants. It also is not uncommon for animals such as cats, rodents or skunks to enter into the floor duct openings during the construction of a house.

Accordingly, it is an object of the present invention to provide a device and method for preventing the build up of debris or other matter within a duct during, for example, the construction of a house or other building.

It is a further object of the present invention to provide such a device and method wherein at least a portion of the device can be quickly and easily removed from the duct and discarded once a predetermined amount of the debris is collected within that portion.

It is still a further object of the present invention to provide such a device that is able to be secured to the duct quickly and easily and to remain substantially within the duct even when air is being passed through the duct by the ventilation system.

SUMMARY

In accordance with these and other objects, a collection device is provided for collecting debris entering into a duct associated with a ventilation system, such as a forced air system or the like, of a house or other building during, for example, the construction of the building. The collection device includes a disposable basket having open and closed ends and defines a chamber that desirably extends from the open end substantially to the closed end. In accordance with a preferred embodiment, the basket is adapted to extend into a hole that is defined by the sub-flooring or other floor structure and is associated with an opening of the duct.

The basket desirably includes a fastening portion and a collecting portion. The fastening portion is adapted to be engaged with the duct in any suitable manner by, for example, securing it to the duct or to the sub-flooring or other floor structure adjacent or about the hole, such that the collecting portion extends into the duct opening and the closed end of the basket is received by the duct. The collecting portion defines a vent, and the collection device further includes a damper for closing the vent and for opening the vent when air is forced through the vent. The vent and damper desirably are annular, and the vent is defined adjacent an upper end of the collecting portion. The material of the collecting portion defining the vent is desirably comprised of a high porous material to permit air passing through the duct to pass through the vent. The damper desirably is comprised of a lightweight material of less porosity than the collecting portion such that the damper can open when air is forced through the vent. The damper may be secured to an inner surface of the collecting portion in any suitable manner.

The collecting portion desirably is detachably secured to the fastening portion in any suitable manner so that the collecting portion and the debris collected therein can be quickly and easily removed from the duct and discarded. In a preferred embodiment, for example, the collecting portion is detachably secured to the fastening portion by perforations or the like that extend around the basket and are spaced from the open end of the basket.

The collection device preferably includes a strap of any suitable configuration to facilitate quick and easy detachment of the collecting portion from the fastening portion and removal of the collecting portion from the duct by manually pulling the strap. The strap preferably is in the form of a drawstring associated with the collecting portion so that the collecting portion also encloses as the drawstring is pulled and as the collecting portion is being detached from the fastening portion. The drawstring desirably includes a pair of loops, which can be pulled separately or together to facilitate detachment and removal of the collecting portion. Preferably, the loops extend into the chamber from the inside surface of the collecting portion of the basket.

If desired, the collection device may include a colored marking or the like on the basket to facilitate quick and easy positioning of the basket relative to the duct. The marking desirably is in the form of an annular ring on the fastening portion that extends around the chamber and is visible on the outer and inner surfaces of the basket. The top of the ring preferably is adapted to be aligned with the end of the duct so that the ring extends substantially within the duct when the fastening portion of the basket is secured to the duct or sub-flooring.

The fastening portion may be engaged with the duct in any suitable manner such as by fasteners or the like. In accordance with an alternative embodiment, the collection device may include a tape or other adhesive for engaging the fastening portion with the duct. If desired, the tape may be secured to an inner surface of the fastening portion. With this embodiment, the leading end of the fastening portion may be folded over so that the tape can be secured to the duct. The device also may include a weight for maintaining the basket substantially within the duct when air is flowing through the duct toward the duct opening.

The present invention also includes a method for collecting and removing debris that enters into the opening of the duct including the steps of engaging the fastening portion of the basket with the duct in any suitable manner, detaching the collecting portion from the fastening portion basket after a predetermined amount of debris has been collected within the collecting portion, and removing the collecting portion from the duct. The detaching and removing steps desirably are performed substantially concurrently by manually pulling the strap away from the duct. Preferably, the collecting portion also encloses as the strap is pulled.

Accordingly, the present invention provides a collection device and method for collecting and removing debris entering into the duct to prevent the build-up of the debris within the duct. The present invention prevents the debris from entering into the ventilation system during construction of the house or building, remodeling, floor sanding, etc., and, thus, will provide a better breathing environment for the occupants of the house or building. The collection device is also adapted to prevent animals from entering the duct. The vent and damper facilitate the passage of air through the collection device.

The invention can be used with any existing duct even if the ventilation system has not yet been completed or is not yet operable. The collection device can be quickly and easily secured to the duct or the sub-flooring or other floor structure and the debris collected by the device can be quickly and easily removed. The device also is inexpensive and relatively easy to manufacture.

BRIEF DESCRIPTION OF DRAWINGS

The present invention and the advantages thereof will become more apparent upon consideration of the following detailed description when taken in conjunction with the accompanying drawings.

DETAILED DESCRIPTION OF PREFERRED EMBODIMENTS

Figure 1:
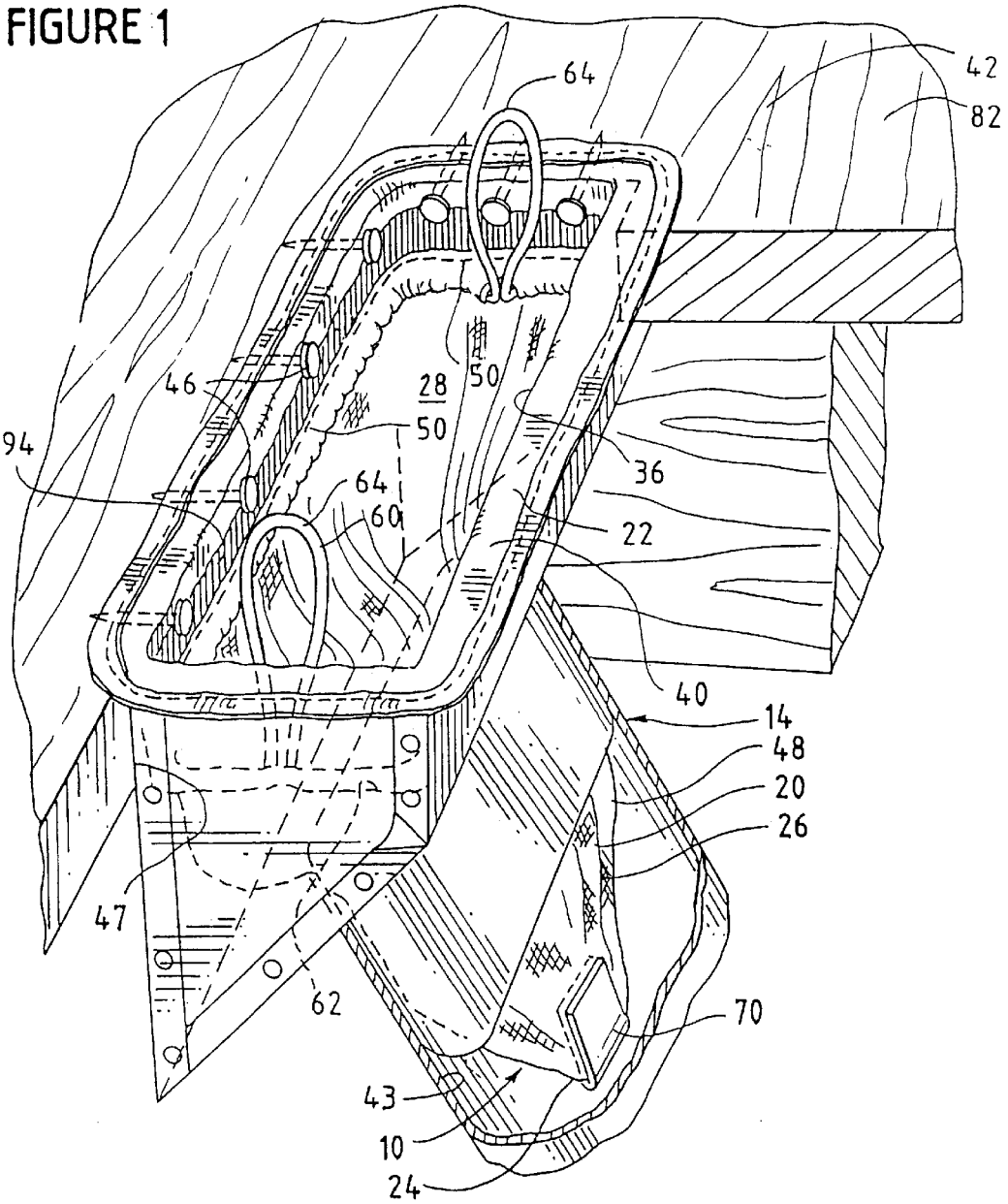
FIG. 1 is a perspective view of a collection device in accordance with one embodiment of the invention and a fragmentary view of a duct and a sub-flooring defining a hole associated with an opening of the duct, illustrating the collection device received within the opening and secured to the duct by a plurality of nails that also secure the duct to the sides of the sub-flooring.

FIGS. 1–4 illustrate a collection device 10 in accordance with preferred embodiments of the invention for collecting debris entering into an opening 12 of a duct 14. The device 10 includes a basket 20 having an open end 22, a closed end 24, and outer and inner surfaces 26 and 28 extending from the open end substantially to the closed end. The basket 20 defines a chamber 36 that also extends from the open end 22 substantially to the closed end 24.

The basket 20 includes a fastening portion 40 that may be secured to the duct 14 or to a sub-flooring 42 or other floor structure that preferably defines a hole 44 adjacent or otherwise associated with the duct opening 12. In the embodiment of FIG. 1, for example, the fastening portion 40 is secured to the inside of the wall 43 of the duct 14 by a plurality of nails 46 that also extend through the duct and into the sides 47 of the sub-flooring 42 that define the hole 44. The basket 20 also includes a collecting portion 48 received within the duct 14 for receiving and collecting the debris. Desirably, the collecting portion 48 is detachably secured to the fastening portion 40 in any suitable manner such as, for example, by perforations 50 or the like. If desired, a portion 52 of the collecting portion 48 may be arcuate to complement a bend or turn 56 often existing in ductwork extending below sub-flooring (see, e.g., FIG. 4). In the illustrated embodiment a leading edge 57 of the fastening portion is folded over and stitched to form a curled edge.

The collection device 10 further includes a strap 60 to facilitate quick and easy detachment of the collecting portion 48 from the fastening portion 40 and removal of the collecting portion from the duct 14 after a predetermined amount of the debris has accumulated in the collecting portion. The strap 60 may be in any form suitable to facilitate detachment and desirably removal of the collecting portion 48. In accordance with a preferred embodiment, the strap 60 is engaged with the collecting portion 48 of the basket 20 so that the collecting portion can be detached and removed from the duct 14 by simply pulling the strap. In the illustrated embodiment, the strap 60 is received within an annular passage 62 defined by the collecting portion 48. In the illustrated embodiment, the passage 62 is defined by stitching. The strap may include two loops 64 extending from the passage 62 into the chamber 36. Desirably, the strap 60 is in the form of a drawstring so that the collecting portion 48 also encloses as the drawstring is pulled.

The basket 20 preferably is constructed of a material or a combination of different materials suitable to allow air to pass through the collecting portion 48. The basket 20 may, for example, be constructed of polyolefin or a similar material. The illustrated collecting portion 48 includes an air flow portion or vent 58 constructed of a high porous material, such as, for example, a synthetic nylon, a nylon, or any other suitable material, to further facilitate air flow through the collecting portion. In the illustrated embodiment, such material is stitched within the collecting portion 48 and the material on either side of the vent 58 desirably is polyolefin. The vent 58 desirably extends annularly, and is near the upper end of the collecting portion 48 so that collected debris does not significantly interfere with the passage of air through the vent.

Figure 2:
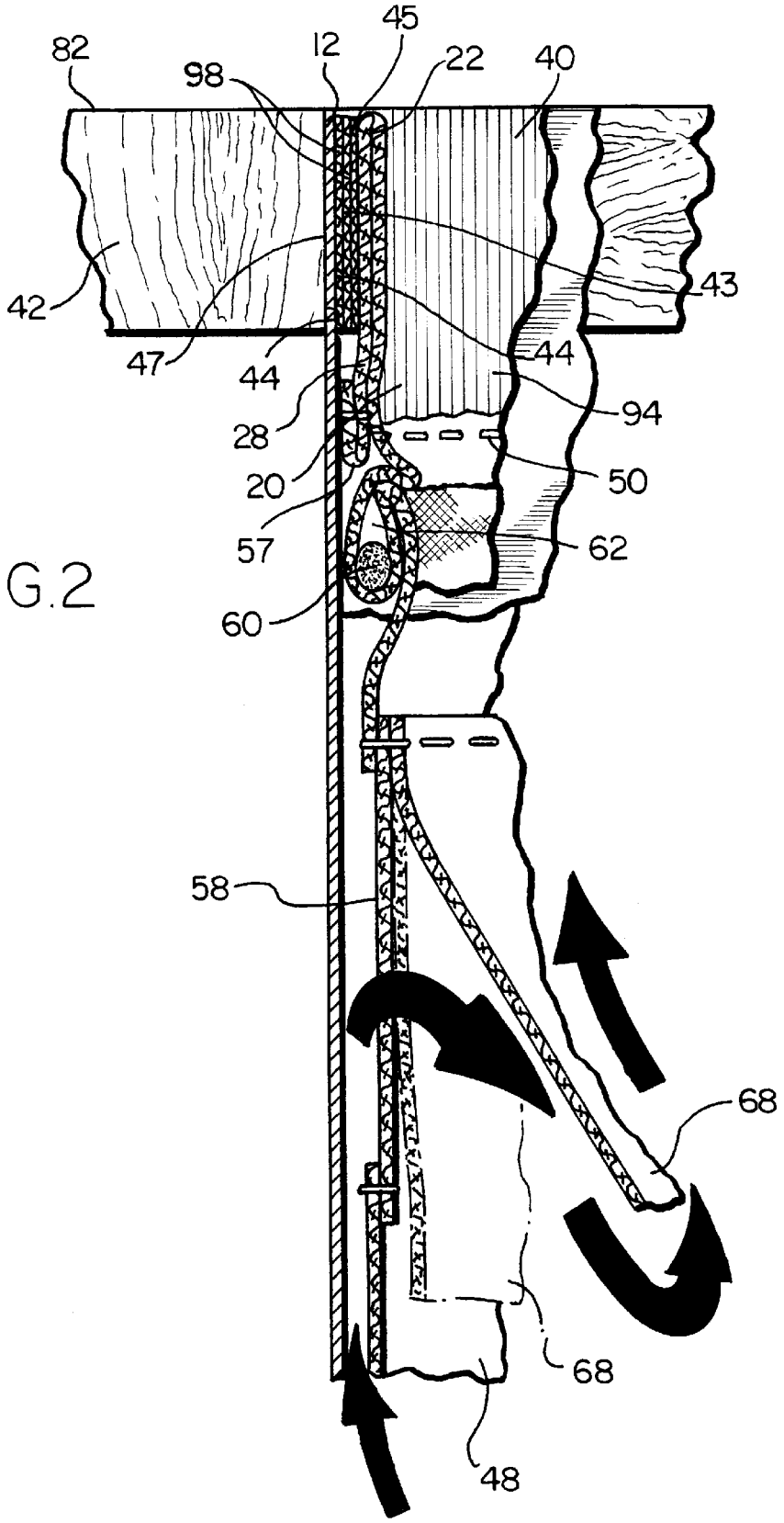
FIG. 2 is a fragmentary cross sectional view of a collection device in accordance with an alternative embodiment illustrating the collection device secured to the duct by an adhesive strip and illustrating the damper in an open position and the flow of air through the vent, with broken lines used to illustrate the damper in a closed position.

The basket 20 desirably also includes an annular damper 68 secured to the inner surface 28 of the collecting portion 48 in any suitable manner such as by stitching. The damper 68 is adapted to cover or close the vent 58 when there is little or no air being forced through the duct 14 to prevent dust or other debris from passing through the vent. The damper 68 opens, however, when air is forced through the duct 14 to facilitate air flow through the collection device 10. The extent that the damper 68 flexes or pivots relative to the vent 58 to open the vent may depend upon many factors such as, for example, the material comprising the damper, the size of the damper, and the air flow rate. In FIG. 2, for example, the damper 68 is illustrated as flexing or pivoting roughly 30° or so.

Desirably, the damper 68 has a height that is equal to or slightly greater than the height of the vent 58 so that the damper can completely cover the vent. The damper 68 desirably is constructed of a lightweight material so that the damper can readily move to open the vent 58 in response to the air flow. Additionally, the damper 68 is comprised of a material that is less porous than the material of the collecting portion 48 defining the vent 58. The damper 68 may, for example, be comprised of a material comprised of cotton, polyester or both. In a preferred embodiment, the material is comprised of about 35% cotton and about 65% polyester.

In accordance with a preferred embodiment of the invention, the collection device 10 also includes a weight 70 associated with the basket 20 for maintaining the closed end 24 of the basket within the duct 14. The weight 70 desirably is secured adjacent the closed end 24 of the basket 20 in any suitable manner. In the illustrated embodiment, for example, the weight 70 is generally rectangular and is clamped to the outer surface 26 of the basket 20 at the closed end 24. Alternatively, the basket 20 may include a pocket or the like which houses the weight 70.

The weight 70 may comprise sheet metal or any other suitable material that desirably is sufficiently heavy to maintain the closed end 24 of the basket 20, and preferably substantially the entire length of the collecting portion 48, within the duct 14 when air is being passed through the duct to the opening 12 by the ventilation system. On the other hand, the weight 70 desirably is sufficiently light such that the collecting portion 48 can be detached from the fastening portion 40 and manually removed from the duct 14 after the predetermined amount of the debris has been received by the collecting portion.

In accordance with a preferred embodiment of the invention, the basket 20 is readily secured to the duct 14 or sub-flooring 42 in any suitable manner, such that the closed end 24 of the basket and most of the length of the basket extends into the duct 14. The manner of securing the basket 20 to the duct 14 or sub-flooring 42 may depend upon the stage of construction of the ductwork and the location and design of the duct 14.

In FIG. 1, for example, the fastening portion 40 is secured to the inside of the wall 43 of the duct 14 by the nails 46. If the duct 14 has not yet been installed, the basket 20 may be positioned within the duct as the duct is being installed, in which case the nails 46 may then be driven through the fastening portion 40 and into the sides 47 of the sub-flooring 42 to also secure the duct to the sub-flooring. If desired, prior to driving the nails 46, the fastening portion 40 may be extended beyond the end 80 of the duct 14 and folded back down along the outside of the duct, in which case the nails are also driven through a portion of the fastening portion outside the duct. Alternatively, the fastening portion 40 may be folded over the top surface 82 of the sub-flooring 42 surrounding the hole 44 so that debris does not fall around the outside of the end 80 of the duct 14 (see, e.g., FIG. 1).

Figure 3:
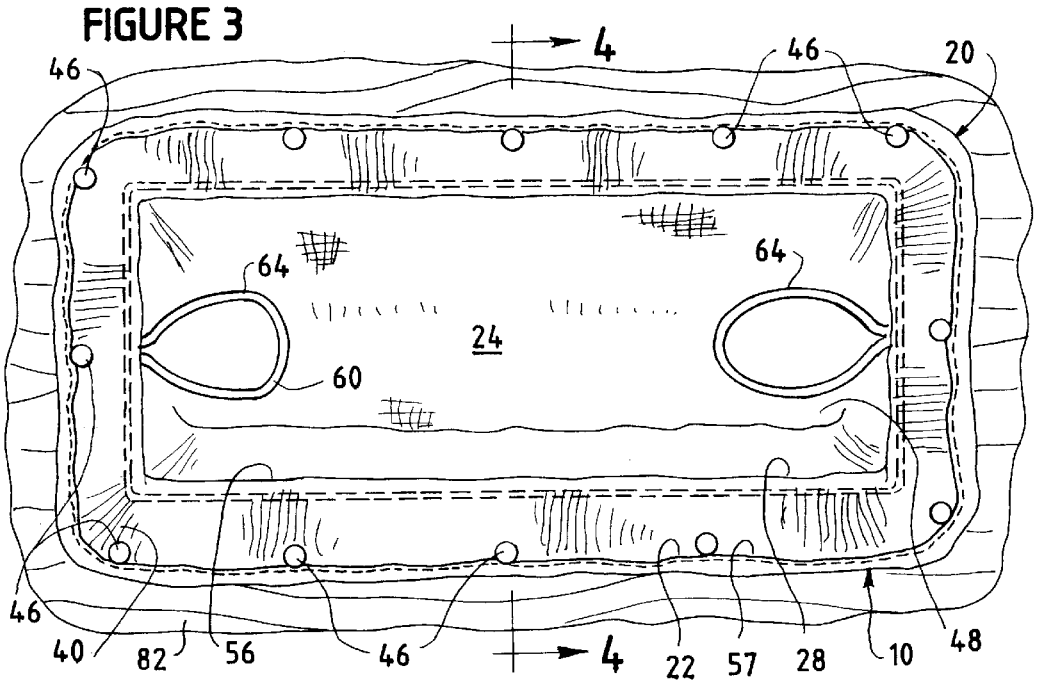
FIG. 3 is a top plan view of the collection device of FIG. 1 secured to a top surface of the sub-flooring.
Figure 4:
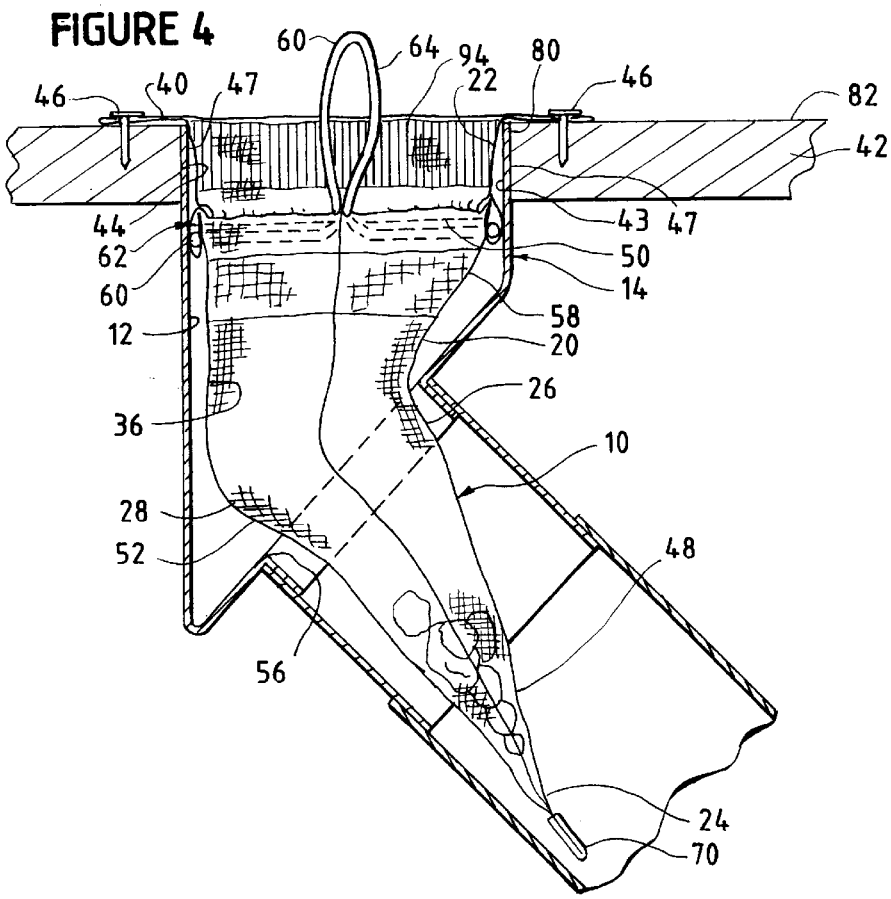
FIG. 4 is a cross section taken along the lines 4—4 of FIG. 3.

As a further alternative, the fastening portion 40 may instead be nailed or otherwise fastened to the top surface 82 of the sub-flooring 42 that surrounds the hole 44 (see, e.g., FIGS. 3 and 4). This method of fastening may be preferable if the duct 14 is already installed.

The collection device 10 desirably further includes a visual marking on the basket 20 to facilitate quick and easy positioning of the basket relative to the duct 14 for securing to the sub-flooring 42. The marking may be in the form of an annular ring 94 visible on the outer and inner surfaces 26 and 28 of the basket 20 that extends around the fastening portion 40. The top of the ring 94 may be aligned with the top surface 82 of the sub-flooring 42 or the end 80 of the duct 14, so that a portion of the fastening portion 40 extending above the ring 94 may extend outside of the duct 14. Alternatively, any other suitable marking may be used to facilitate positioning of the basket 20 relative to the duct 14.

In accordance with a further alternative embodiment, an adhesive strip 45 may be used to secure the fastening portion 40 to the duct 14 or sub-flooring 42. For example, as illustrated in FIG. 2, the adhesive strip 45 may be secured to the inner surface 28 of the fastening portion 40. With this embodiment, the leading portion 57 of the fastening portion 40 is folded back so that the adhesive strip 45 can be secured to the inner wall 43 of the duct 14 or the sides 47 of the sub-flooring 42. Desirably, the adhesive strip 45 is immediately adjacent the annular ring 94. In the illustrated embodiment, the adhesive strip 45 is in the form of two-sided tape having adhesive 98 on both sides. The tape may include a release layer. Alternatively, the adhesive strip 45 may instead be secured to the outer surface 26 of the fastening portion 40 for securing to the inner wall 43 of the duct 14 or to the top surface 82 of the sub-flooring 42.

The present invention also includes a method for collecting and removing debris that enters into the duct opening 12 including the steps of (a) engaging the fastening portion 40 of the basket 20 with the duct 14 such that the collecting portion 48 extends into the duct 14 and the closed end 24 of the basket 20 is received by the duct, (b) detaching the collecting portion 48 from the fastening portion after a predetermined amount of debris has been collected within the collecting portion, and (c) removing the collecting portion from the duct 14. Step (a) may include rigidly securing the fastening portion 40 to the duct 14 or to the sub-flooring 42 or other floor structure by the nails 46, tacks or any other fasteners, the adhesive strip 45, or any other suitable securing means. During step (a), the vent 58 and damper 68 facilitate air flow through the collection device 10.

Steps (b) and (c) may be performed substantially concurrently by pulling one or both of the loops 64 of the strap 60 away from the duct 14. Desirably, the collecting portion 48 substantially encloses as the loop 64 is pulled. The collecting portion 48 and the debris contained therein may then be discarded. The collection device 10 is also adapted to prevent animals from entering the duct 14.

The present invention provides several benefits. For example, it prevents the build-up of debris within the duct and from entering into the ventilation system during construction of a house or other building, remodeling, floor sanding, etc. The device is easy to use since it can be quickly and easily secured to the duct or sub-flooring or other floor structure, and the collecting portion of the basket and the debris can be quickly and easily removed and discarded. The vent 58 facilitates ventilation through the collection device 10, and the damper 68 is intended to prevent debris from passing through the vent. The present invention will provide a better breathing for the occupants of the house or other building by controlling the debris which can enter the ventilation system. The device in accordance with preferred embodiments is also inexpensive and relatively easy to manufacture.

The foregoing description is for purposes of illustration only and is not intended to limit the scope of protection accorded this invention. The scope of protection is to be measured by the following claims, which should be interpreted as broadly as the inventive contribution permits.

The claimed invention is:

1. A method for collecting and removing debris entering into an opening of a duct or a building, the method comprising the steps of:

(a) engaging with the duct a collection device comprising a basket having a fastening portion, a collecting portion detachably secured to the fastening portion, an open end, a closed end, and defining a chamber extending from the open end toward the closed end, such that the collecting portion is received by the opening and extends into the duct and the closed end is in the duct;

(b) detaching the collecting portion of the basket from the fastening portion of the basket after a predetermined amount of debris has been received by the collecting portion; and (c) removing the collecting portion from the duct.

2. The method of claim 1 wherein steps (b) and (c) are performed substantially concurrently.

3. The method of claim 2 wherein the collection device includes a strap associated with the collecting portion and steps (b) and (c) include pulling the strap.

4. The method of claim 3 wherein the collecting portion encloses as the strap is pulled.

5. The method of claim 1 wherein step (a) includes securing the fastening portion of the basket to a floor structure that defines a hole associated with the duct opening.

6. The method of claim 5 wherein step (a) includes securing the fastening portion of the basket to the floor structure by a plurality of nails.

7. The method of claim 1 wherein step (a) includes securing the fastening portion to the duct.

8. The method of claim 7 wherein step (a) includes securing the fastening portion to the duct by a plurality of nails that extend through the duct and into sides of a sub-flooring that defines a hole associated with the duct opening.

9. The method of claim 1 wherein step (a) includes securing the fastening portion to the duct with an adhesive.

10. The method of claim 1 wherein step (a) includes securing the fastening portion to the duct with a two-sided tape secured to an inner surface of the fastening portion.

11. The method of claim 1 wherein step (a) includes folding a leading end of the fastening portion back down along the outside of the duct and securing the fastening portion to the duct with a two-sided tape secured to an inner surface of the fastening portion.

12. The method of claim 1 wherein step (a) includes securing the fastening portion to the duct with a two-sided tape secured to an outer surface of the fastening portion.

13. The method of claim 1 wherein the collection device includes a weight associated with the closed end of the basket for maintaining the closed end within the duct prior to step (b).

14. The method of claim 1 wherein the fastening portion includes a marking and step (a) includes aligning the marking with an end of the duct that defines the duct opening.

15. The method of claim 1 wherein the collecting portion defines a vent.

16. The method of claim 15 wherein the collection device further comprises a damper for closing the vent and for opening the vent when air is forced through the duct.

17. The method of claim 16 wherein the vent and damper extend annularly and the vent is defined adjacent an upper end of the collecting portion.

18. The method of claim 16 wherein the damper is secured to an inner surface of the collecting portion.

19. The method of claim 18 wherein the damper is secured to the inner surface of the collecting portion by stitching.

20. The method of claim 18 wherein the damper is secured to the inner surface of the collecting portion by an adhesive.

21. The method of claim 16 wherein the damper and vent are configured such that the damper is adapted to completely cover one side of the vent when the vent is closed by the damper.

22. The method of claim 16 wherein the material of the collecting portion defining the vent comprises a material having a porosity higher than the porosity of the material comprising the damper.

* * * * *